United States Patent [19]

Richeson et al.

[11] Patent Number: 4,967,702

[45] **Date of Patent: * Nov. 6, 1990**

[54] FAST ACTING VALVE

[75] Inventors: William E. Richeson; Frederick L. Erickson, both of Fort Wayne, Ind.

[73] Assignee: Magnavox Government and Industrial Electronics Company, Fort Wayne, Ind.

[ * ] Notice: The portion of the term of this patent subsequent to Apr. 10, 2007 has been disclaimed.

[21] Appl. No.: 295,177

[22] Filed: Jan. 6, 1989

[51] Int. Cl.[5] ..... F15B 13/044; F01B 11/02; F01L 9/02

[52] U.S. Cl. ..... 123/90.14; 137/625.64; 91/459; 91/465; 92/85 B; 251/63.5; 123/90.24

[58] Field of Search ..... 123/90.11, 90.12, 90.14, 123/90.24; 137/625.64, 625.6; 91/459, 465; 92/85 B; 251/129.05, 129.21, 63.5

[56] References Cited

U.S. PATENT DOCUMENTS

| | | | |
|---|---|---|---|
| 4,582,082 | 4/1986 | Tosseghini | 251/63.5 |
| 4,741,364 | 5/1988 | Stoss et al. | 137/625.6 |
| 4,742,989 | 5/1988 | Akagi | 251/129.05 |
| 4,777,915 | 10/1988 | Bonvallet | 123/90.11 |
| 4,809,587 | 3/1989 | Kawahara et al. | 91/465 |

FOREIGN PATENT DOCUMENTS

| | | | |
|---|---|---|---|
| 197808 | 8/1978 | Fed. Rep. of Germany | 123/90.14 |

*Primary Examiner*—Charles J. Myhre

*Assistant Examiner*—Weilun Lo

*Attorney, Agent, or Firm*—Roger M. Rickert; Thomas A. Briody; Richard T. Seeger

[57] ABSTRACT

A bistable electronically controlled pneumatically powered transducer for use, for example, as a valve mechanism actuator in an internal combustion engine is disclosed. The transducer has a piston which is coupled to an engine valve, for example. The pistion is powered by a pneumatic source and is held in each of its extreme positions by pneumatic pressure under the control of control valves which are in turn held in their closed positions by pressurized air and/or permanent magnet latching arrangements and are released therefrom to supply air to the piston to be pneumatically driven to the other extreme position by an electromagnetic neutralization of the permanent magnet field. A pair of auxiliary pistons movable with the piston compress air to a pressure above the pressure of the pneumatic source for aiding reclosure of the control valves as well as aiding maintenance of those control valves in their closed positions thereby reducing the size and cost of the latching permanent magnets. Air return springs for the control valves are formed by annular chambers which are sealed by initial control valve motion away from their respective closed positions. Thereafter, the chamber size diminishes linearly, and the chamber pressure increases approximately linearly, with further control valve motion thereby providing a restorative force to the control valve which increases as the valve opens.

6 Claims, 15 Drawing Sheets

FAST ACTING VALVE

SUMMARY OF THE INVENTION

The present invention relates generally to a two position, straight line motion actuator and more particularly to a fast acting actuator which utilizes pneumatic energy against a piston to perform fast transit times between the two positions. The invention utilizes a pair of control valves to gate high pressure air to the piston and permanent magnets to hold the control valves in their closed positions until a coil is energized to neutralize the permanent magnet latching force and open one of the valves stored pneumatic gases accelerate the piston rapidly from one position to the other position. Movement of the piston from one position to the other traps some air adjacent the face of the working piston opposite the face to which accelerating air pressure is being applied creating an opposing force on the piston to slow the piston as it nears the end of its travel. An additional damping of piston motion and retrieval of portion of the kinetic energy of the piston is accomplished by an auxiliary piston which moves with the main or working piston and compresses air to help reclose the control valve.

This actuator finds particular utility in opening and closing the gas exchange, i.e., intake or exhaust, valves of an otherwise conventional internal combustion engine. Due to its fast acting trait, the valves may be moved between full open and full closed positions almost immediately rather than gradually as is characteristic of cam actuated valves.

The actuator mechanism may find numerous other applications such as in compressor valving and valving in other hydraulic or pneumatic devices, or as a fast acting control valve for fluidic actuators or mechanical actuators where fast controlled action is required such as moving items in a production line environment.

Internal combustion engine valves are almost universally of a poppet type which are spring loaded toward a valve-closed position and opened against that spring bias by a cam on a rotating cam shaft with the cam shaft being synchronized with the engine crankshaft to achieve opening and closing at fixed preferred times in the engine cycle. This fixed timing is a compromise between the timing best suited for high engine speed and the timing best suited to lower speeds or engine idling speed.

The prior art has recognized numerous advantages which might be achieved by replacing such cam actuated valve arrangements with other types of valve opening mechanism which could be controlled in their opening and closing as a function of engine speed as well as engine crankshaft angular position or other engine parameters.

For example, in U.S. Patent Application Ser. No. 226,418 entitled VEHICLE MANAGEMENT COMPUTER filed in the name of William E. Richeson on July 29, 1988 there is disclosed a computer control system which receives a plurality of engine operation sensor inputs and in turn controls a plurality of engine operating parameters including ignition timing and the time in each cycle of the opening and closing of the intake and exhaust valves among others. U.S. Pat. No. 4,009,695 discloses hydraulically actuated valves in turn controlled by spool valves which are themselves controlled by a dashboard computer which monitors a number of engine operating parameters. This patent references many advantages which could be achieved by such independent valve control, but is not, due to its relatively slow acting hydraulic nature, capable of achieving these advantages. The patented arrangement attempts to control the valves on a real time basis so that the overall system is one with feedback and subject to the associated oscillatory behavior.

In copending application Ser. No. 021,195, now U.S. Pat. No. 4,794,890, entitled ELECTROMAGNETIC VALVE ACTUATOR, filed Mar. 3, 1987 in the name of William E. Richeson and assigned to the assignee of the present application, there is disclosed a valve actuator which has permanent magnet latching at the open and closed positions. Electromagnetic repulsion may be employed to cause the valve to move from one position to the other. Several damping and energy recovery schemes are also included.

In copending application Ser. No. 153,257, now U.S. Pat. 4,878,464, entitled PNEUMATIC ELECTRONIC VALVE ACTUATOR, filed Feb. 8, 1988 in the names of William E. Richeson and Frederick L. Erickson and assigned to the assignee of the present application there is disclosed a somewhat similar valve actuating device which employs a release type mechanism rather than a repulsion scheme as in the previously identified copending application. The disclosed device in this application is a jointly pneumatically and electromagnetically powered valve with high pressure air supply and control valving to use the air for both damping and as one motive force. The magnetic motive force is supplied from the magnetic latch opposite the one being released and this magnetic force attracts an armature of the device so long as the magnetic field of the first latch is in its reduced state. As the armature closes on the opposite latch, the magnetic attraction increases and overpowers that of the first latch regardless of whether it remains in the reduced state or not. This copending application also discloses different operating modes including delayed intake valve closure and a six stroke cycle mode of operation.

In copending application Ser. No. 158,155 filed Feb. 8, 1988 in the names of William E. Richeson and Frederick L. Erickson, assigned to the assignee of the present application and entitled PNEUMATICALLY POWERED VALVE ACTUATOR there is disclosed a valve actuating device generally similar in overall operation to the present invention. One feature of this application is that control valves and latching plates have been separated from the primary working piston to provide both lower latching forces and reduced mass resulting in faster operating speeds. This concept is incorporated in the present invention and it is one object of the present invention to further improve these two aspects of operation.

Copending applications Ser. Nos. 209,273, now U.S. Pat. No. 4,873,948, and 209,279, now U.S. Pat. No. 4,852,528, entitled respectively PNEUMATIC ACTUATOR WITH SOLENOID OPERATED CONTROL VALVES and PNEUMATIC ACTUATOR WITH PERMANENT MAGNET CONTROL VALVE LATCHING, filed in the names of William E. Richeson and Frederick L. Erickson, assigned to the assignee of the present invention and both filed on June 20, 1988 address, among other things, the use of air pressure at or below source pressure to aid in closing and maintaining closed the control valves along with improvements in operating efficiency over the above noted devices.

Other related applications all assigned to the assignee of the present invention and filed in the name of William E. Richeson on Feb. 8, 1988 are Ser. No. 07/153,262, now U.S. Pat. No. 4,883,025, entitled POTENTIAL-MAGNETIC ENERGY DRIVEN VALVE MECHANISM where energy is stored from one valve motion to power the next and where a portion of the motive force for the device comes from the magnetic attraction from a latch opposite the one being currently neutralized as in the abovenoted Ser. No. 158,257; and Ser. No. 07/153,154, now U.S. Pat. No. 4,831,973 entitled REPULSION ACTUATED POTENTIAL ENERGY DRIVEN VALVE MECHANISM wherein a spring (or pneumatic equivalent) functions both as a damping device and as an energy storage device ready to supply part of the accelerating force to aid the next transition from one position to the other.

In Applicants' assignee docket No. F-903, now U.S. Pat. No. 4,875,441, filed in the names of Richeson and Erickson, the inventors herein, on even date herewith and entitled ENHANCED EFFICIENCY VALVE ACTUATOR, there is disclosed a pneumatically powered valve actuator which has a pair of air control valves with permanent magnet latching of those control valves in closed position. The magnetic latching force (and therefor, the size/cost) of the latching magnets is reduced by equalizing air pressure on the control valve which heretofor had to be overcome by the magnetic attraction. Damping requirements for the main reciprocating piston are reduced because there is a recapture and use of the kinetic energy of the main piston to reclose the control valve. The main piston shaft has O-ring sealed "bumpers" at each end to drive the air control valve closed should it fail to close otherwise.

In Applicants' assignee docket No. F-904, now U.S. Pat. No. 4,872,425, filed in the names of Richeson and Erickson on even date herewith and entitled AIR POWERED VALVE ACTUATOR, the reciprocating piston of a pneumatically driven valve actuator has several air passing holes extending in its direction of reciprocation to equalize the air pressure at the opposite ends of the piston. The piston also has an undercut which, at the appropriate time, passes high pressure air to the back side of the air control valve thereby using air being vented from the main piston of the valve to aid in closing the control valve. The result is a higher air pressure closing the control valve than the air pressure used to open the control valve.

In Applicants' assignee docket F-909, application Ser. No. 294,727, filed in the names of Richeson and Erickson on even date herewith and entitled PNEUMATIC ACTUATOR, an actuator has one-way pressure relief valves similar to the relief valves in the abovementioned Ser. No. 209,279 to vent captured air back to the high pressure source. The actuator also has "windows" or venting valve undercuts in the main piston shaft which are of reduced size as compared to the windows in other of the cases filed on even date herewith resulting in a higher compression ratio. The actuator of this application increases the area which is pressurized when the air control valve closes thereby still further reducing the magnetic force required.

In Applicants' assignee docket F-910, application Ser. No. 294,729, filed in the name of William E. Richeson on even date herewith and entitled ELECTRO-PNEUMATIC ACTUATOR, an actuator which reduces the air demand on the high pressure air source by recovering as much as possible of the air which is compressed during damping. The main piston provides a portion of the magnetic circuit which holds the air control valves closed. When a control valve is opened, the control valve and the main piston both move and the reluctance of the magnetic circuit increases dramatically and the magnetic force on the control valve is correspondingly reduced.

In Applicants' assignee docket F-911, application Ser. No. 295,178, names of Richeson and Erickson on even date herewith and entitled COMPACT VALVE ACTUATOR, the valve actuator cover provides a simplified air return path for low pressure air and a variety of new air venting paths allow use of much larger high pressure air accumulators close to the working piston.

All of the above noted cases filed on even date herewith have a main or working piston which drives the engine valve and which is, in turn powered by compressed air. The power or working piston which moves the engine valve between open and closed positions is separated from the latching components and certain control valving structures so that the mass to be moved is materially reduced allowing very rapid operation. Latching and release forces are also reduced. Those valving components which have been separated from the main piston need not travel the full length of the piston stroke, leading to some improvement in efficiency. Compressed air is supplied to the working piston by a pair of control valves with that compressed air driving the piston from one position to another as well as typically holding the piston in a given position until a control valve is again actuated. The control valves are held closed by permanent magnets and opened by an electrical pulse in a coil near the permanent magnet. All of the cases employ "windows" which are cupped out or undercut regions on the order of 0.1 inches in depth along a somewhat enlarged portion of the shaft of the main piston, for passing air from one region or chamber to another or to a low pressure air outlet. These cases may also employ a slot centrally located within the piston cylinder for supplying an intermediate latching air pressure as in the abovenoted Ser. No. 153,155 and a reed valve arrangement for returning air compressed during piston damping to the high pressure air source as in the abovenoted Ser. No. 209,279.

The entire disclosures of all of the above identified copending applications are specifically incorporated herein by reference.

Among the several objects of the present invention may be noted the provision of a bistable fluid powered actuating device characterized by fast transition times and improved efficiency; the provision of a pneumatically driven actuating device having more rapidly reacting control valves; the provision of an electronically controlled pneumatically powered valve actuating device having auxiliary pistons which aid both damping and reclosure of control valves; the provision of an electronically controlled pneumatically powered valve actuating device having air pressurized above the pressure of the air source for reclosing air control valves; the provision of a valve actuating device having air supply control valves and air chambers which retain and compress air during the time the control valves are opening which compressed air acts as an air spring to aid reclosing of the air control valves; and the provision of a valve actuating device having fast response air control valves. These as well as other objects and advantageous features of the present invention will be in part apparent and in part pointed out hereinafter.

In general, a subpiston segment of the main piston slidingly engages the inside bore of the air control valve as the air valve opens. The high pressure air accelerating the main piston causes the subpiston to compress air in an annular chamber and the increased pressure in that chamber aids reclosing of the air control valve. Since high pressure air recloses the control valves, one driver circuit rather than two may be used.

Also in general and in one form of the invention, a bistable electronically controlled fluid powered transducer has an air powered piston which is reciprocable along an axis between first and second positions along with a control valve reciprocable along the same axis between open and closed positions. A pneumatic latching arrangement functions to hold the control valve in the closed position while an electromagnetic arrangement may be energized to temporarily override the effect of the latching arrangement to release the control valve to move from the closed position to the open position. Energization of the electromagnetic arrangement causes movement of the control valve in one direction along the axis allowing fluid from a high pressure source to enter the closed chamber and drive the piston in the opposite direction from the first position to the second position along the axis. Piston motion compresses air in a separate chamber for subsequently forcing the control valve back to a closed position.

Still further in general and in one form of the invention, a pneumatically powered valve actuator includes a valve actuator housing with a piston reciprocable inside the housing along an axis. The piston has a pair of oppositely facing primary working surfaces. A pair of air control valves are reciprocable along the same axis relative to both the housing and the piston between open and closed positions. A coil is electrically energized to selectively open one of the air control valves to supply pressurized air to one of the primary working surfaces causing the piston to move. Closure of the air control valve is aided by air which has been compressed by motion of the piston. Such compression may be effected by auxiliary pistons at opposite ends of the piston which may compress air to a pressure above the pressure of the air driving the main piston.

Again in general, a pneumatically powered valve actuator includes a valve actuator housing, a piston with a pair of primary working surfaces reciprocable within the housing, a pressurized air source a low pressure air outlet and a pair of air control valves reciprocable relative to both the housing and the piston between open and closed positions. An electromagnetic arrangement selectively opens one of said air control valves to supply pressurized air from the air source to one of said primary working surfaces causing the piston to move. The air control valve is reclosed by a progressively increasing pressure in an annular chamber which communicates with both a further chamber within the actuator and the low pressure air outlet when the air control valve is in the closed position. The air control valve is effective upon motion toward its open position to seal the annular chamber from both the further chamber and the low pressure outlet forming a sealed chamber of air to be compressed by further motion of the air control valve. The annular chamber functions as an air return spring for the air control valve with air control valve motion away from the closed position causing the chamber size to diminish linearly, and the chamber pressure to increase approximately linearly, as a function of air control valve motion thereby providing a restorative force to the control valve which increases as the valve opens.

BRIEF DESCRIPTION OF THE DRAWING

Corresponding reference characters indicate corresponding parts throughout the several views of the drawing.

Figure 1:
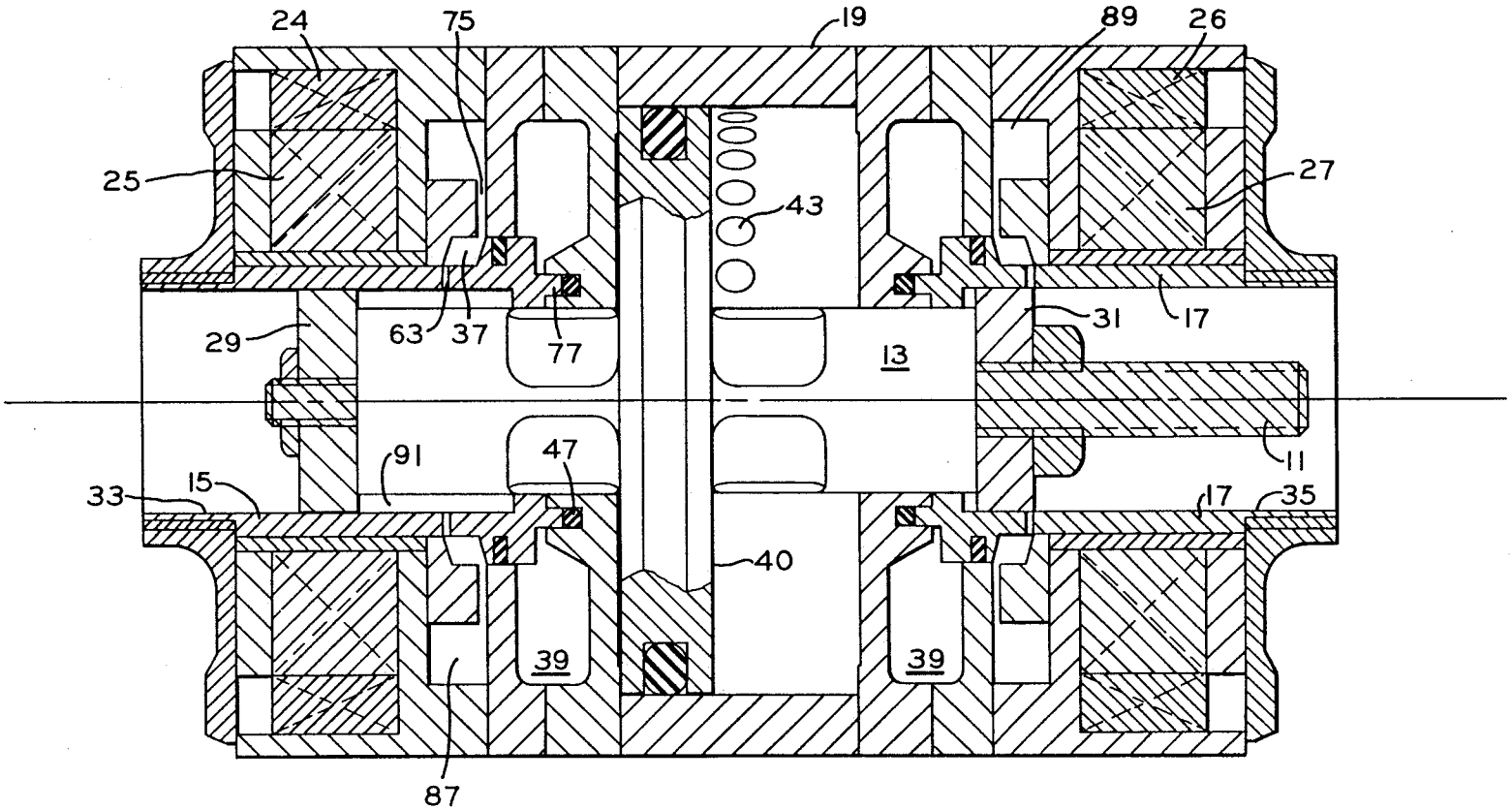
FIG. 1 is a view in cross-section showing the pneumatically powered actuator of the present invention with the power piston latched in its leftmost position as it would normally be when the corresponding engine valve is closed.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

The valve actuator is illustrated sequentially in FIGS. 1–7 to illustrate various component locations and functions in moving a poppet valve or other component (not shown) from a closed to an open position. Motion in the opposite direction will be clearly understood from the symmetry of the components. Generally speaking, a pneumatically powered valve actuator is shown having a valve actuator housing 19 and a piston 13 reciprocable within the housing along the axis of the shaft or stem 11. The piston 18 has a pair of oppositely facing primary working surfaces 88 and 40, a pressurized air source 89, a pair of air control valves 15 and 17 reciprocable along the axis relative to both the housing in and the piston 13 between open and closed positions. A magnetic neutralization coil 24 or 26 may be energized to neutralize the latching effect of a permanent magnet 25 or 27 for selectively opening one of the air control valves 15 or 17 to supply pressurized air from the air source to one of said primary working surfaces causing the piston to move.

The actuator includes a shaft or stem 11 which may form a part of or connect to an internal combustion engine poppet valve. The actuator also includes a reciprocable piston 13, and a pair of reciprocating or sliding control valve members 15 and 17 enclosed within the housing 19. The control valve members 15 and 17 are latched in a closed position by a combination of the attractive forces of magnets 25 and 27, and may be dislodged from their respective latched positions by energization of coils 24 and 26. The control valve members or shuttle valves 15 and 17 cooperate with both the piston 18 and the housing 19 to achieve the various porting functions during operation. The housing 19 has a high pressure inlet port 89 and low pressure outlet port 87 similar to the inlet and outlet ports of many of the above identified copending applications. The low pressure may be about atmospheric pressure while the high pressure is on the order of 90–100 psi gauge pressure. An intermediate or latching air pressure source may, as in earlier applications, supply air at, for example, about 9–10 psi to the annular slot 43.

Figure 1A:
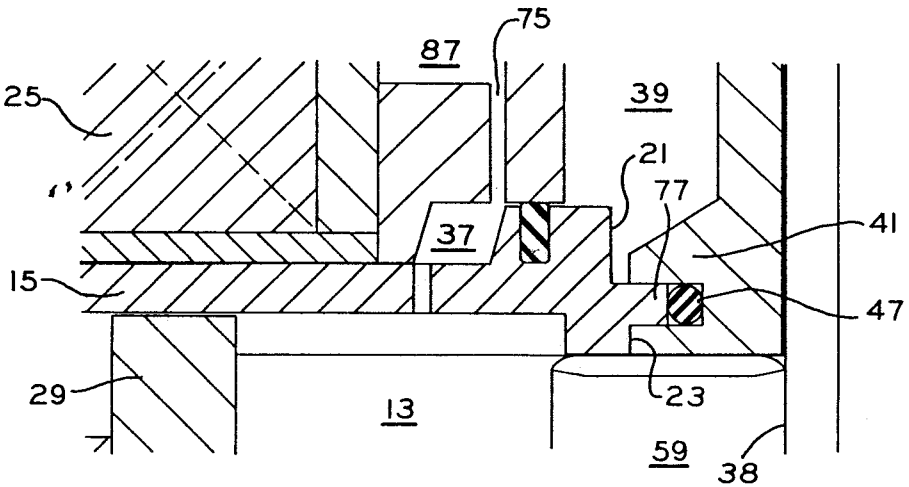
FIG. 1*a* is an enlarged cross-section view showing the interaction of the control valve and subpiston.

This actuator incorporates a fast acting control valve. FIGS. 1 and 1*a* show an initial state With piston 13 in the extreme leftward position and with the air control valve 15 latched closed. In this state, the annular abutment end surface 77 is inserted into an annular slot in the housing 19 and seals against an o-ring 47. This seals the pressure in cavity 39 and prevents the application of any moving force to the main piston 13. In this position, the main piston 13 is being urged to the left (latched) by the pressure on working surface 40. FIG. 1 illustrates the actuator with the power piston 18 latched in the far leftmost position as it would be when the corresponding engine valve is closed. The subpiston annular chamber 91 is at atmospheric pressure when the main piston is at rest. The subpiston 29 or 31 slidingly engages the inside bore 33 or 35 of the air control valve 15. The subpiston chamber 91 works in conjunction with a simple air valve spring subchamber 37 and is vented to the atmosphere through port 63, subchamber 87 and port 75. Permanent magnet 25 holds air control valve 15 in a closed state.

Figure 2:
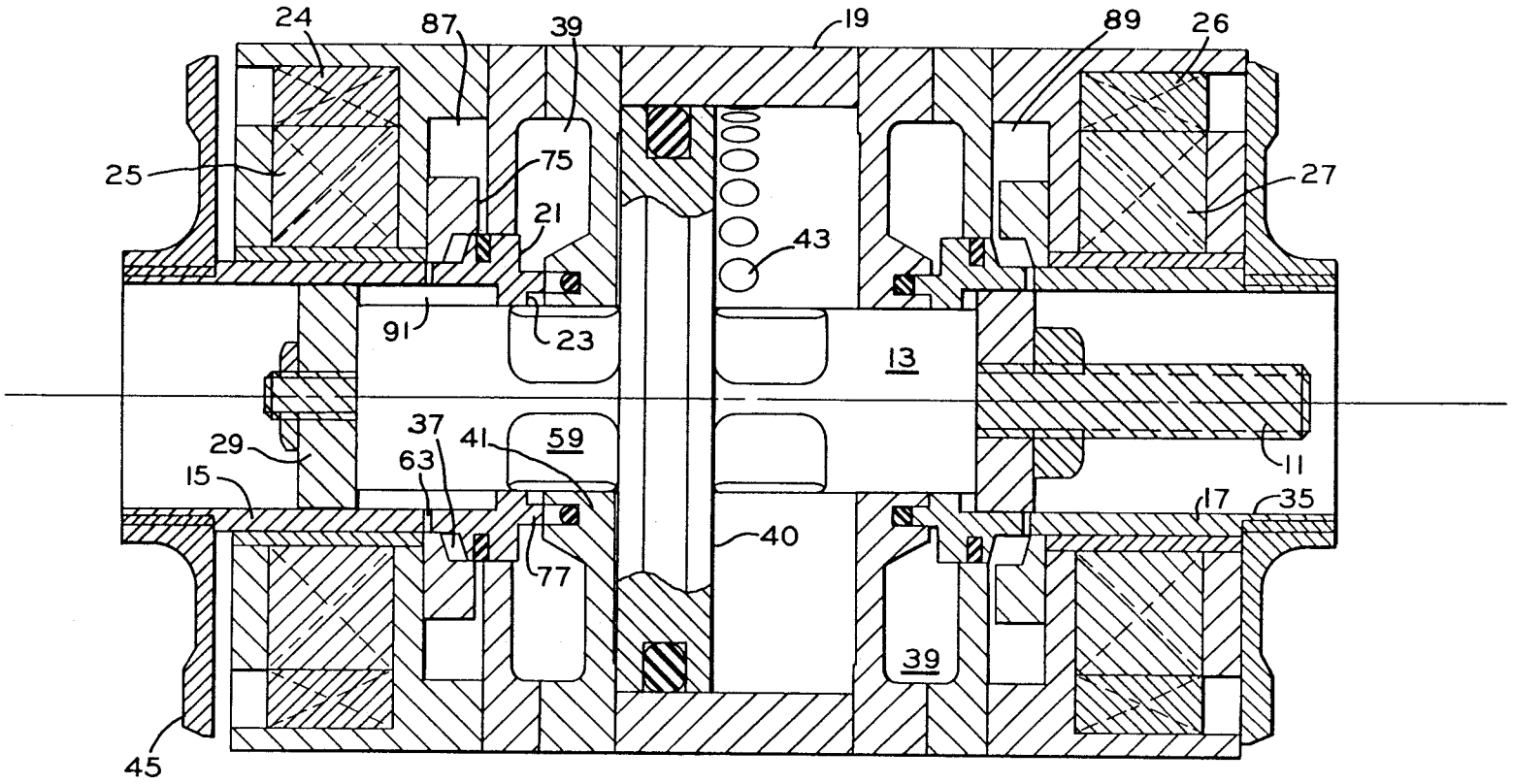
FIGS. 2–7 are views in cross-section similar to FIG. 1, but illustrating component motion and function as the piston progresses rightwardly to its extreme rightward or valve open position.
Figure 3:
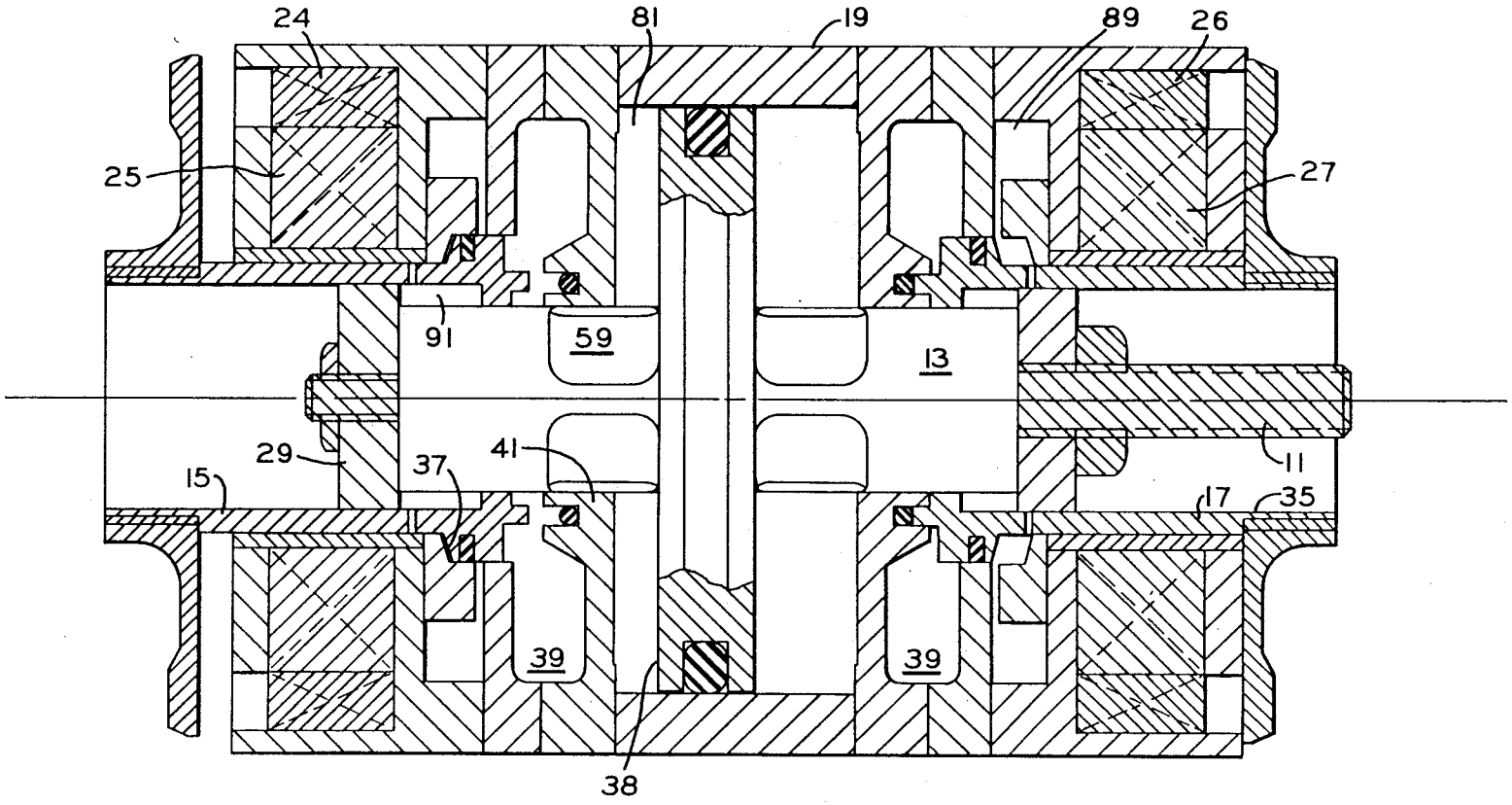

In FIG. 2, the shuttle valve 15 has moved toward the left, for example, 0.06 in. while piston 13 has not yet moved toward the right while FIG. 3 shows the opening of the air valve 15 to about 0.11 in. and movement of the piston 13 about 0.140 in. to the right. In FIG. 2, the high pressure air had been supplied to the cavity 39 and to the face 38 of piston 13 driving that piston toward the right. In FIG. 2 coil 24 is energized and the field from permanent magnet 25 is decreased until the air control valve 15 is free to move. Air valve 15 is accelerated from the high pressure in chamber 39 acting on control valve faces 21 and 23. Atmospheric port 75 is now closed by control valve 15 and subchamber 87 acts as a simple spring. Subchamber 37 is now being compressed. Port 68 is now closed, no longer venting subpiston chamber 91 to subchamber 87 and to the atmosphere. The subpiston chamber 91 acts as a complex air spring being compressed. The motion of subpiston 29 and air valve 15 is towards each other, this makes up a nonlinear changing volume thus creating the complex air spring. The air valve 15 has traveled approximately half of its total travel. As tang 77 slides clear of the body 41 portion of the main housing 19, main piston 13 is accelerated by the high pressure from chamber 39 through window 59. Window 59 and the other windows to be discussed subsequently are a series of peripheral undercuts in an otherwise cylindrical portion of the main piston.

In FIG. 3 air valve 15 has traveled to its full open position, and simple air spring subchamber 37 is compressed fully. Atmospheric air in subpiston chamber 91 continues to be compressed and a small amount of energy is being extracted from the main piston 18 by subpiston 29 due to the building pressure in subpiston chamber 91. That high pressure air supply by way of cavity 39 to piston face 38 is cut off in FIG. 8 by the edge of the window 59 of piston 13 passing the annular abutment 41 of the housing 19. Piston 13 continues to accelerate, however, due to the expansion energy of the high pressure air in cavity 81. Window 59 has cut off main piston 13 from the source pressure. The main piston 13 has now traveled thirty percent of its total travel and the high pressure in main piston cylinder 81 is being expanded.

Figure 4:
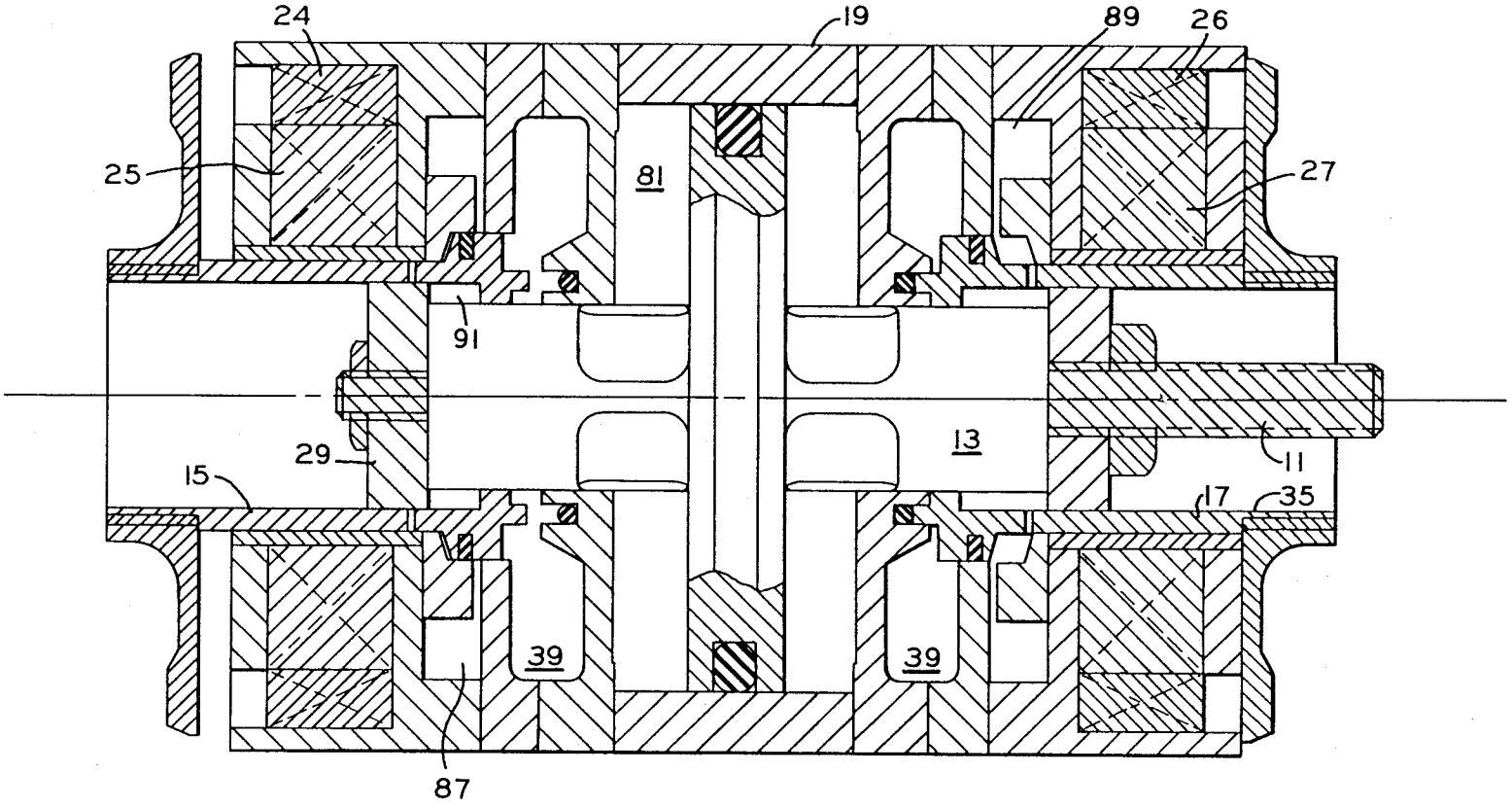

In FIG. 4 air valve 15 is fully open and the atmospheric air in subpiston chamber 91 is being compressed to a higher value. More energy is being extracted from the main piston 13 by subpiston 29. The high pressure in main cylinder 81 has been fully expanded and the left side of main cylinder 81 is vented to latching or intermediate pressure by way of slot 43. The air on the right side of the main cylinder 81 is beginning to be compressed and dampening of main piston 13 has begun.

Figure 5:
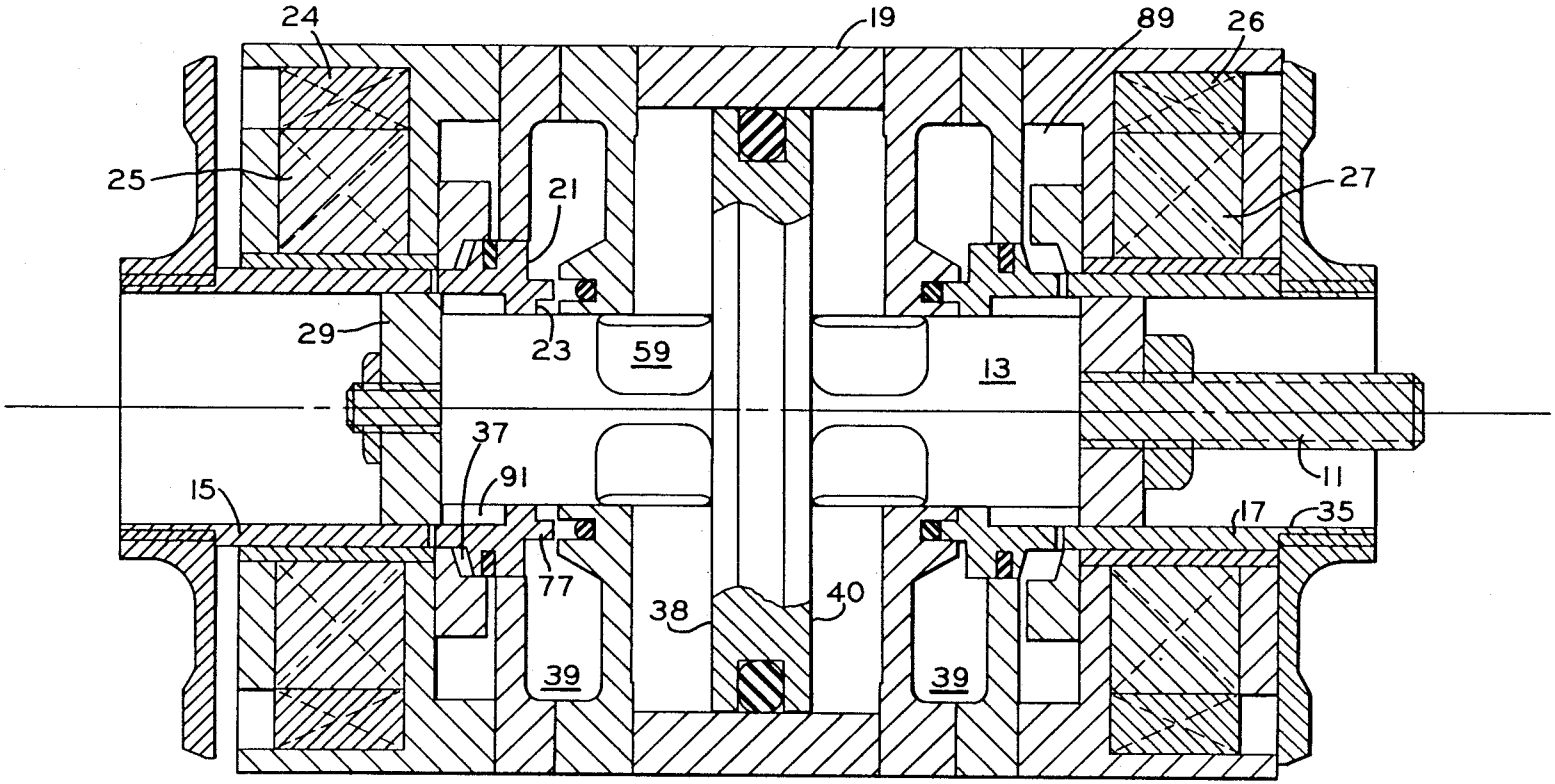

In FIG. 5 the pressure in subchamber 37 and subpiston chamber 91 is just beginning to overcome the source pressure in chamber 39 and about to cause air valve 15 to be accelerated back toward its closed position as in FIG. 1. Even more energy is being extracted from main piston 1 by subpiston 29. The pressure on the working surface 38 on the left side of main piston 13 is at latching pressure and the pressure on the opposite working surface 40 on the right side of main piston 13 continues to grow and dampen the actuator.

Figure 6:
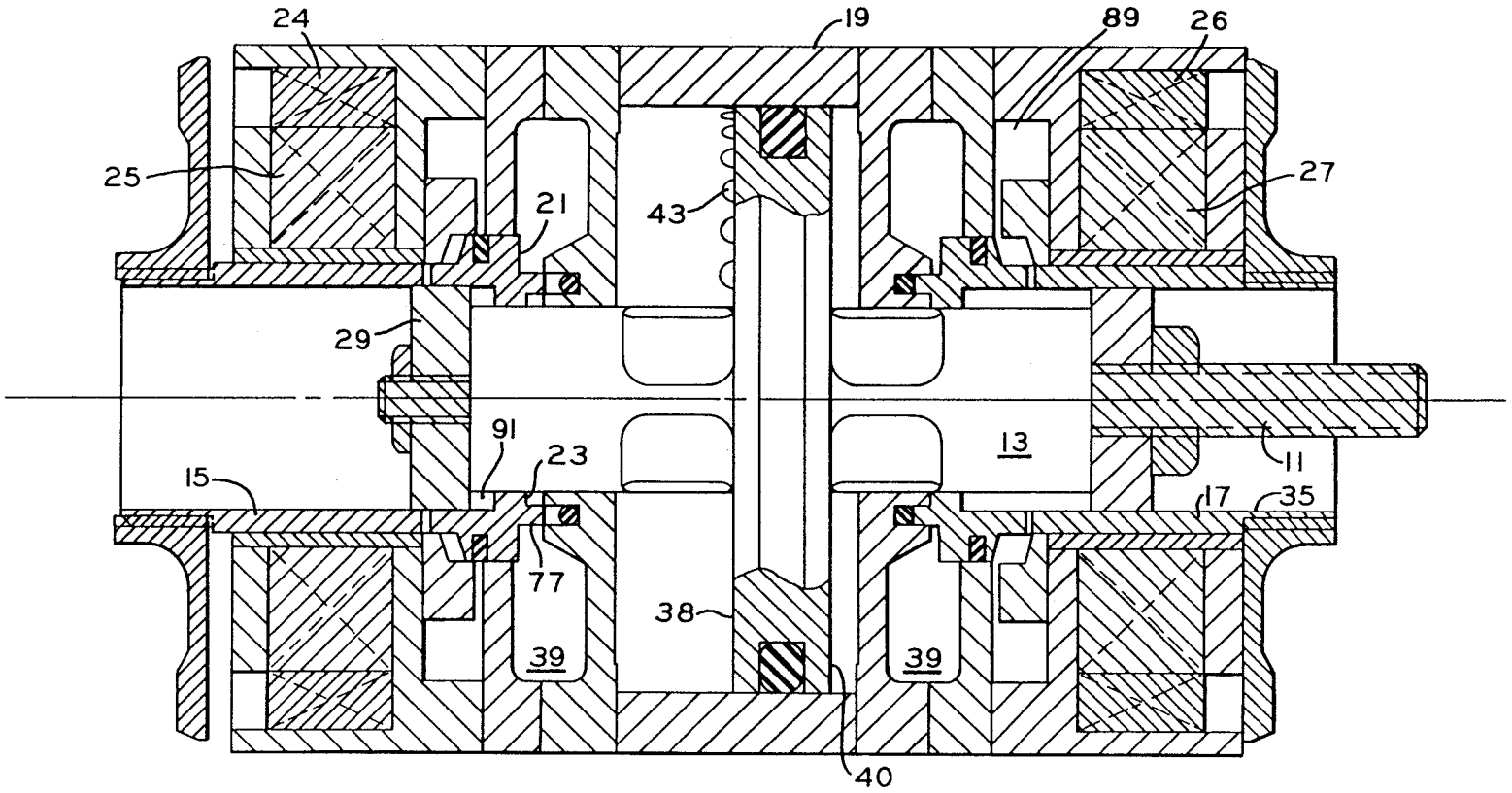

In FIG. 6 the pressure in subchamber 37 and subpiston chamber 91 has overpowered the source pressure in chamber 39 and air valve 15 is on its way back to its position of FIG. 1. The tang 77 has turned off the source pressure on the face 21 of air valve 15. Even more energy is now being extracted from main piston 13 by subpiston 29. The pressure on the left side 38 of main piston 13 is at the latching or intermediate pressure of source 43 and the pressure on the right side 40 of main piston 13 continues to grow and dampen the actuator.

Figure 7:
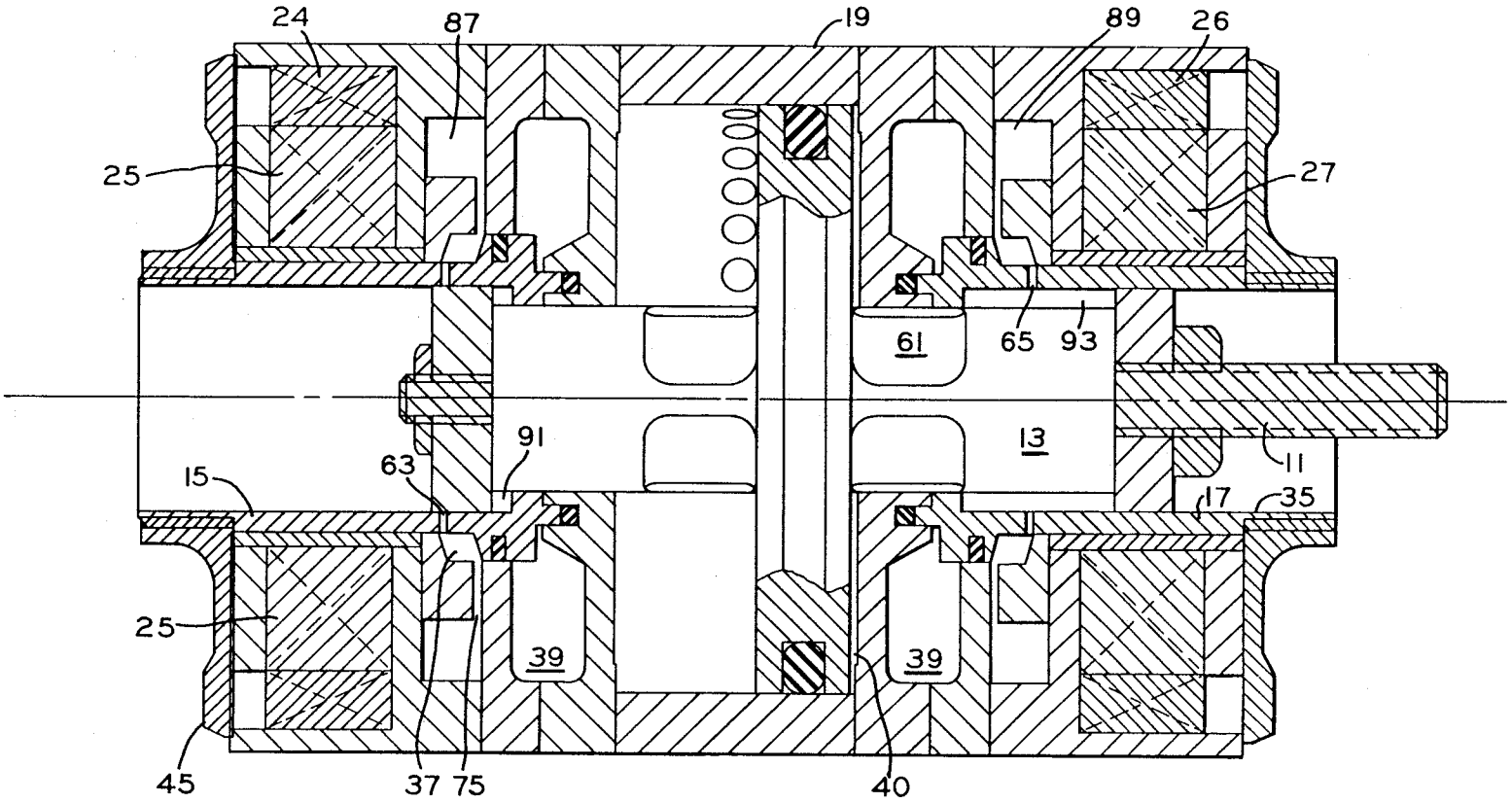

In FIG. 7 the air valve 15 has returned to its closed position as in FIG. 1. The pressure in subchamber 37 has vented to the atmosphere through port 75. The pressure in subpiston chamber 91 still remains high. insuring positive latching of air valve 15 with the ferromagnetic disk 45 spanning the annular pole pieces associated with the permanent magnet 25. The pressure in subpiston chamber 91 remains high until main piston 13 returns to its position in figure 1 and vents subpiston chamber 91 through ports 63 and 75 and subchamber 87. One advantage of this positive latching force is both coils 24 and 26 can be pulsed at the same time, thus reducing the need for two coil drivers. A second advantage is the permanent magnet 25 can be weaker than permanent magnets used on previous actuators. The force versus distance requirements are not as demanding using this positive latching actuator.

The main piston 13 in FIG. 7 has completed its travel and the piston damping pressure on the right side 40 of main piston has vented through window 61 into subpiston chamber 93 through port 65 and out to the atmosphere through subchamber 89. One transition of the actuator is now complete and essentially the same process as above may be followed in the return transition.

Variations of the actuator are possible. One possibility is to change air valve 15, window 59 and tang 77 as to allow high pressure air to fill subpiston chamber 91 immediately. Using high pressure in the subpiston chamber 91 in conjunction with the simple air spring of subchamber 37 will allow air valve 15 to close more rapidly. Another configuration of this actuator incorporating this possibility is illustrated in FIGS. 8–14.

Figure 8:
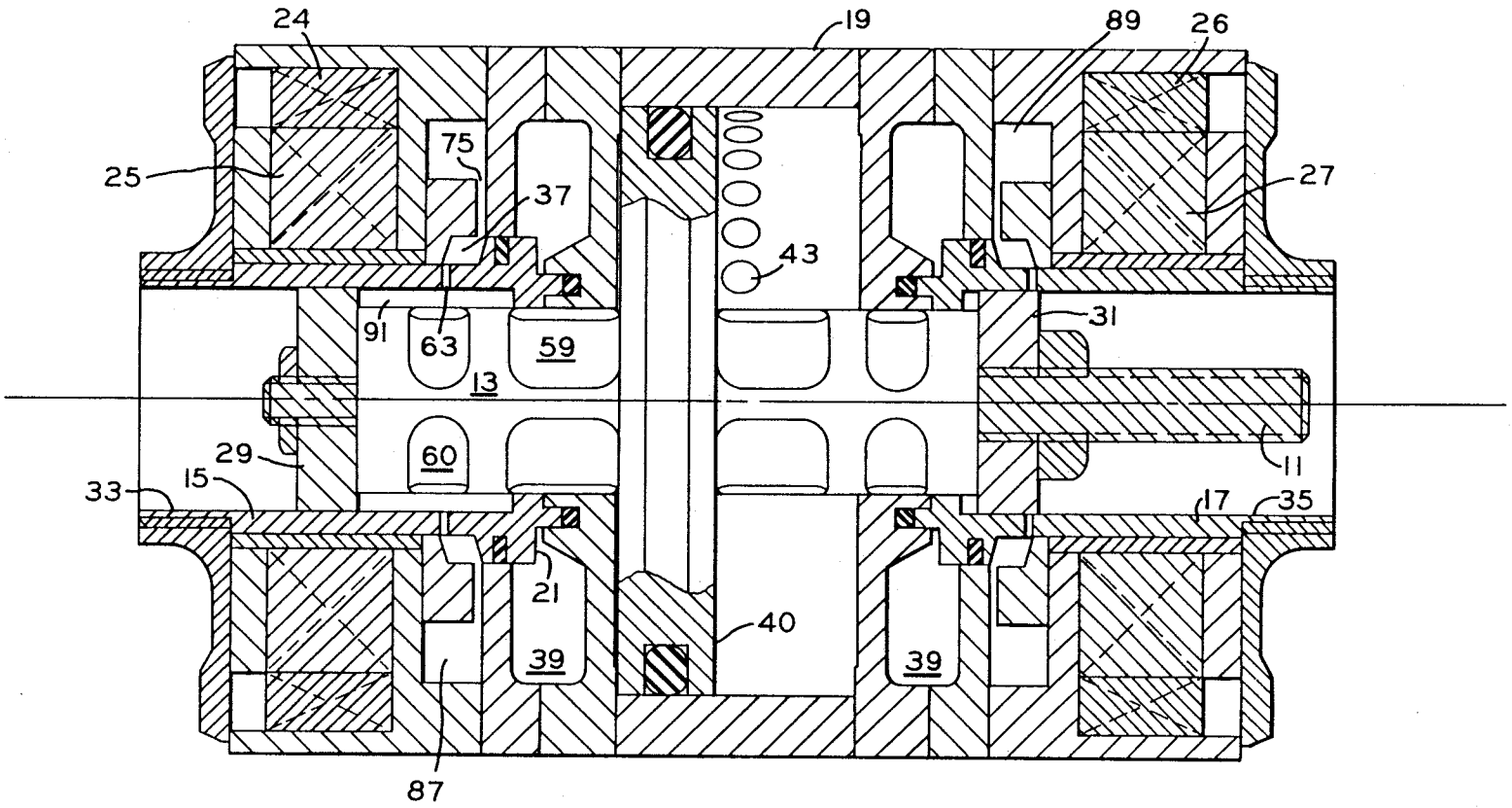
FIGS. 8–14 are views in cross-section similar to FIGS. 1–7, but illustrating component motion and function as a modified piston progresses rightwardly to its extreme rightward or valve open position.

FIG. 8 is similar to FIG. 1 except a second set of windows 60 have been added to main piston 13 to incorporate an even faster closing air valve. FIG. 8 illustrates the actuator with the power piston latched in the far leftmost position as it would be when the corresponding engine valve is closed. The subpiston chamber 91 of the main piston in FIG. 8, is at atmospheric pressure when the main piston is at rest. Subpiston chamber 91 is vented to the atmosphere through port 63 and subchamber 87. Air valve 15 has high pressure applied to face 21 from chamber 39. Permanent magnet 25 holds air valve 15 in a closed state.

Figure 9:
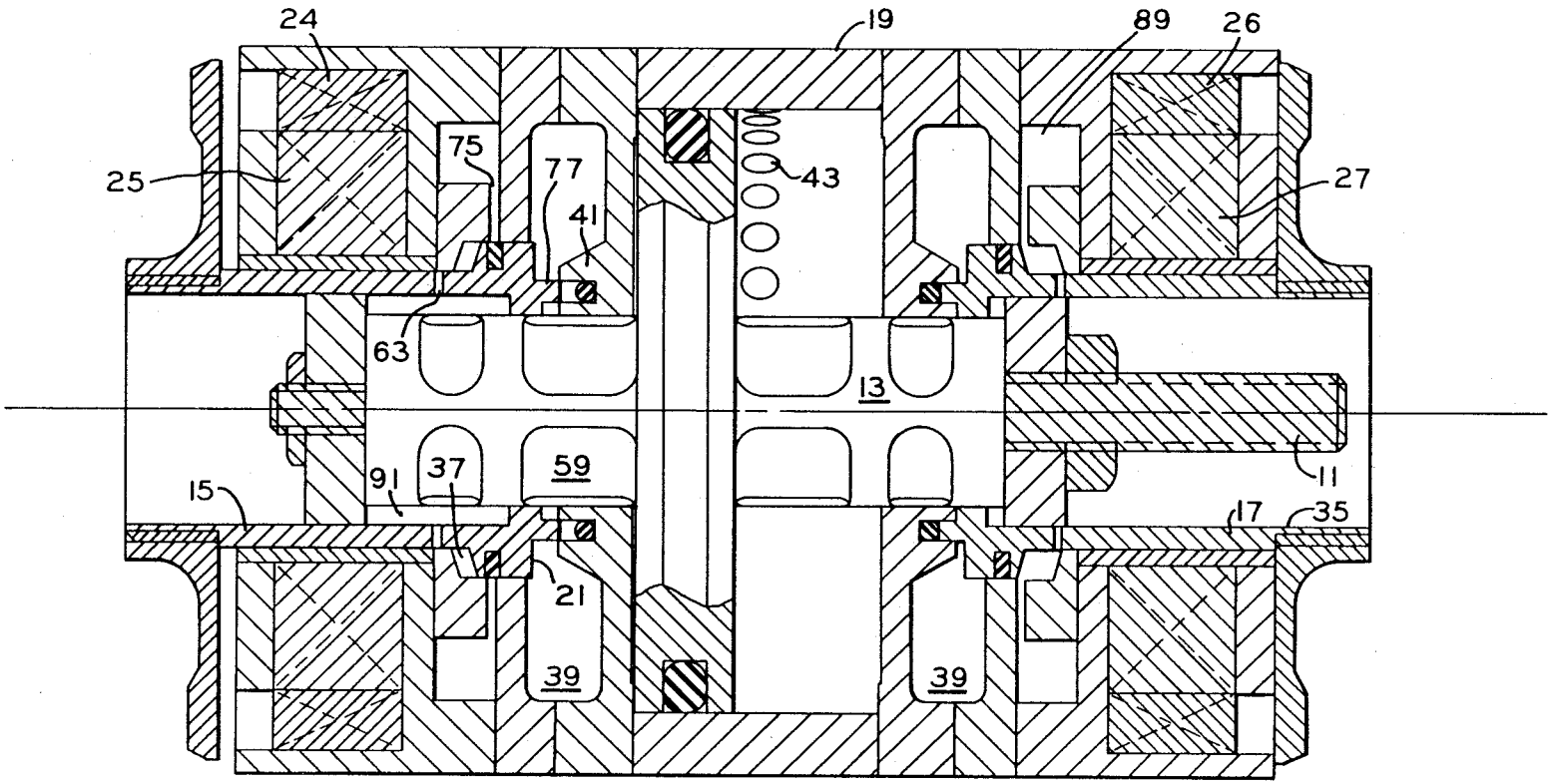

In FIG. 9 coil 24 is energized and the field from permanent magnet 25 is decreased until the air valve 15 is free to move. Air control valve 15 is accelerated from the high pressure in chamber 39 acting on face 21. Atmospheric port 75 is now closed as is port 63 and subchamber 37 acts as a simple spring as stated above. Subchamber 37 is now being compressed. Port 63 is now closed, no longer venting subpiston chamber 91 to subchamber 87 and to the atmosphere. The subpiston chamber 91 acts as a complex air spring being compressed as stated above. The air valve 15 has traveled approximately half of its total travel. As tang 77 slides past body 41, main piston 13 is accelerated by the high pressure from chamber 39 through window 59.

Figure 10:
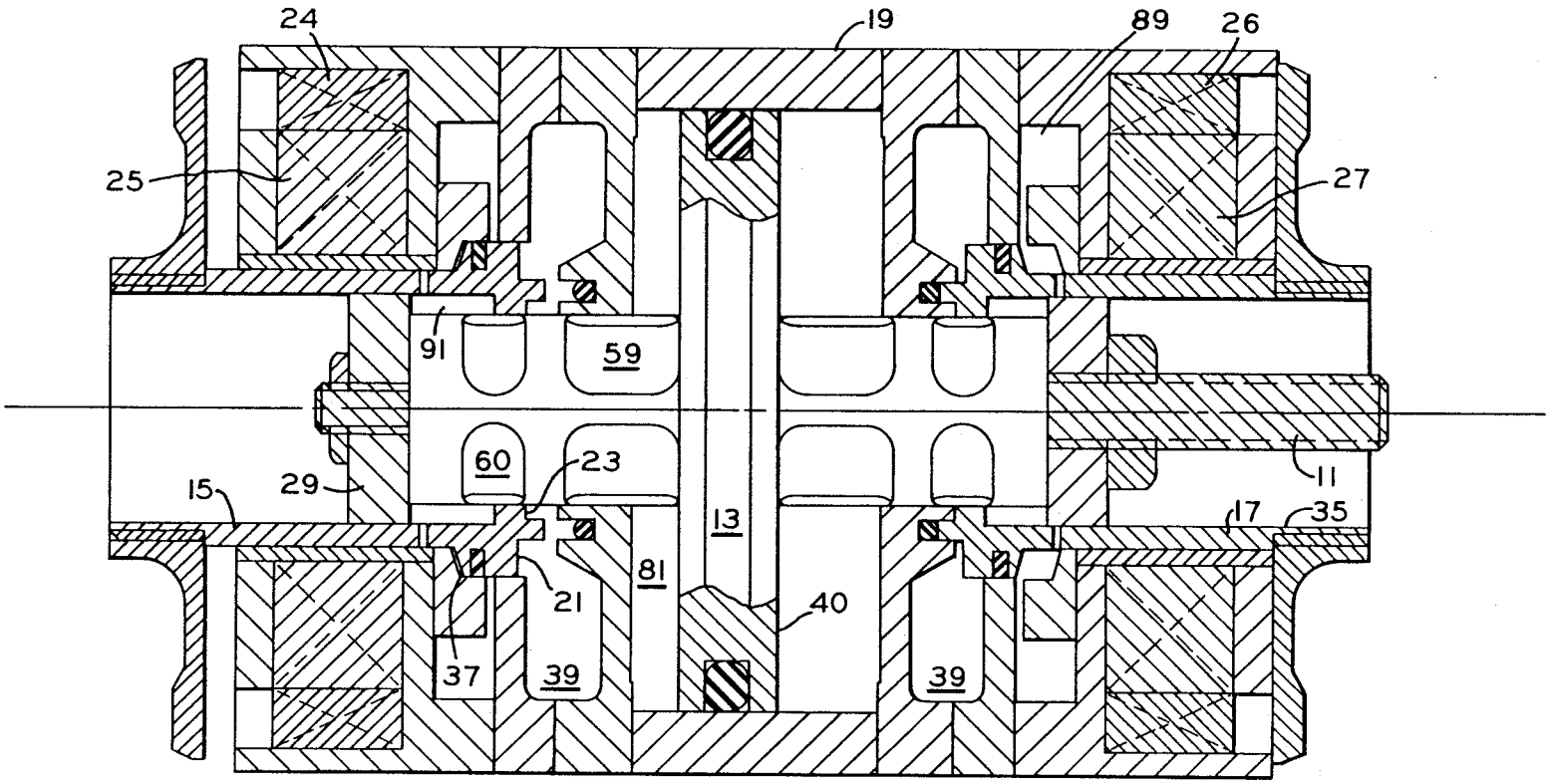

In FIG. 10 air control valve 15 has traveled to its full open position, and simple air spring subchamber 87 is compressed fully. Air in subpiston chamber 91 continues to be compressed and a small amount of energy is being extracted from the main piston 13 by subpiston 29 due to the building pressure in subpiston chamber 91. Window 59 has cut off main piston chamber 81 from the source pressure. The main piston 13 has now traveled thirty percent of its total travel and the high pressure in main piston cylinder 81 is being expanded.

Figure 11:
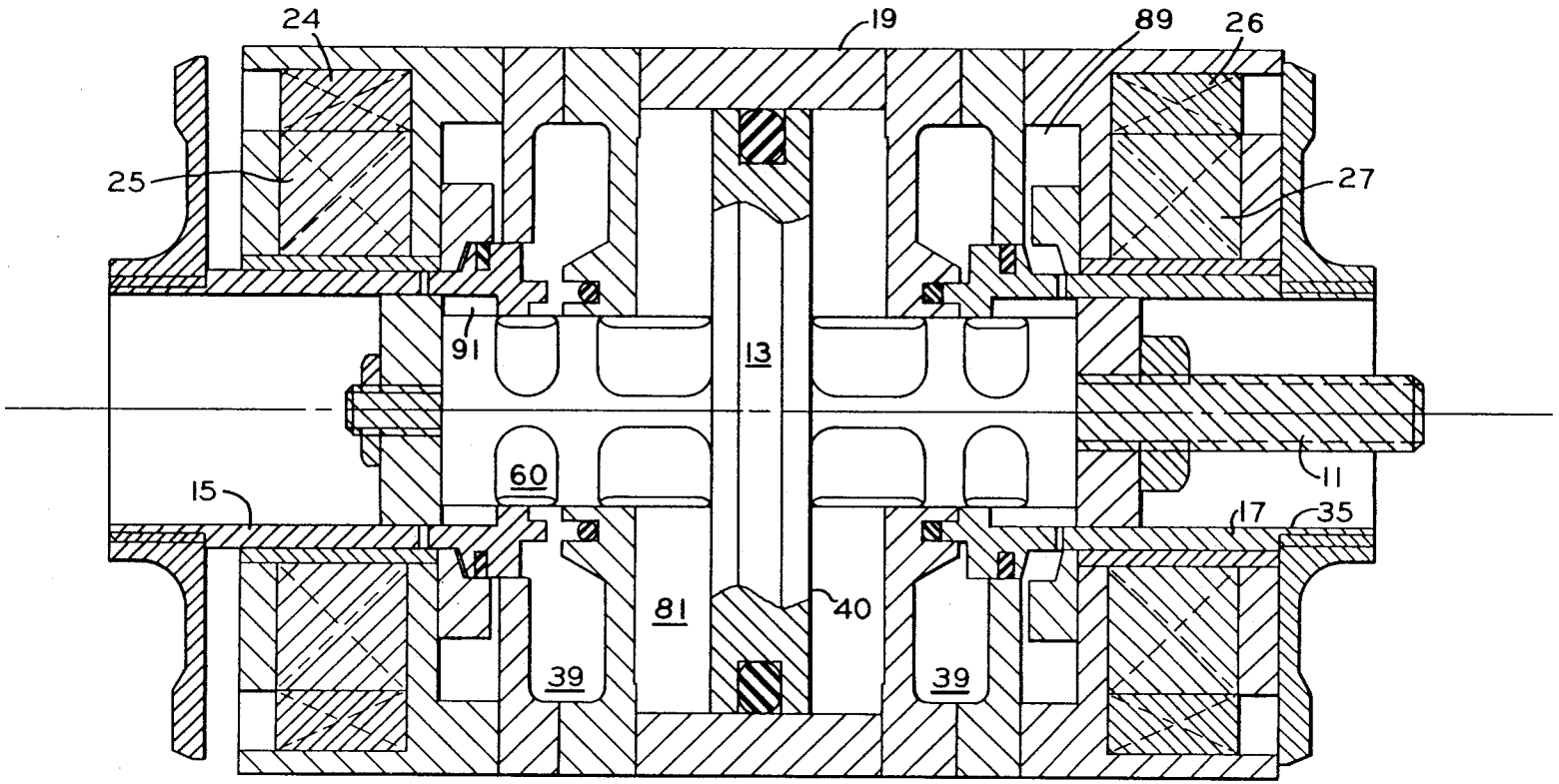

In FIG. 11 main piston 18 has moved sufficiently far that window 60 has shut off high pressure air that was previously vented into subpiston chamber 91. Window 60 vents a minimum amount of high pressure air into subpiston chamber 91 as to neutralize some of the effects of high pressure air on the face 21 of air valve 15. The presence of high pressure air in subpiston chamber 91 allows air valve 15 to close much faster than in the previous discussed actuator. A much higher closing force is developed sooner in subpiston chamber 91. The high pressure in main cylinder 81 has been full and the left side of main cylinder 81 will be vented to latching pressure when the edge of the piston uncovers slot 43. The pressure on the right side (adjacent face 40) of the main cylinder 81 is beginning to be compressed and dampening of main piston 13 has begun.

Figure 12:
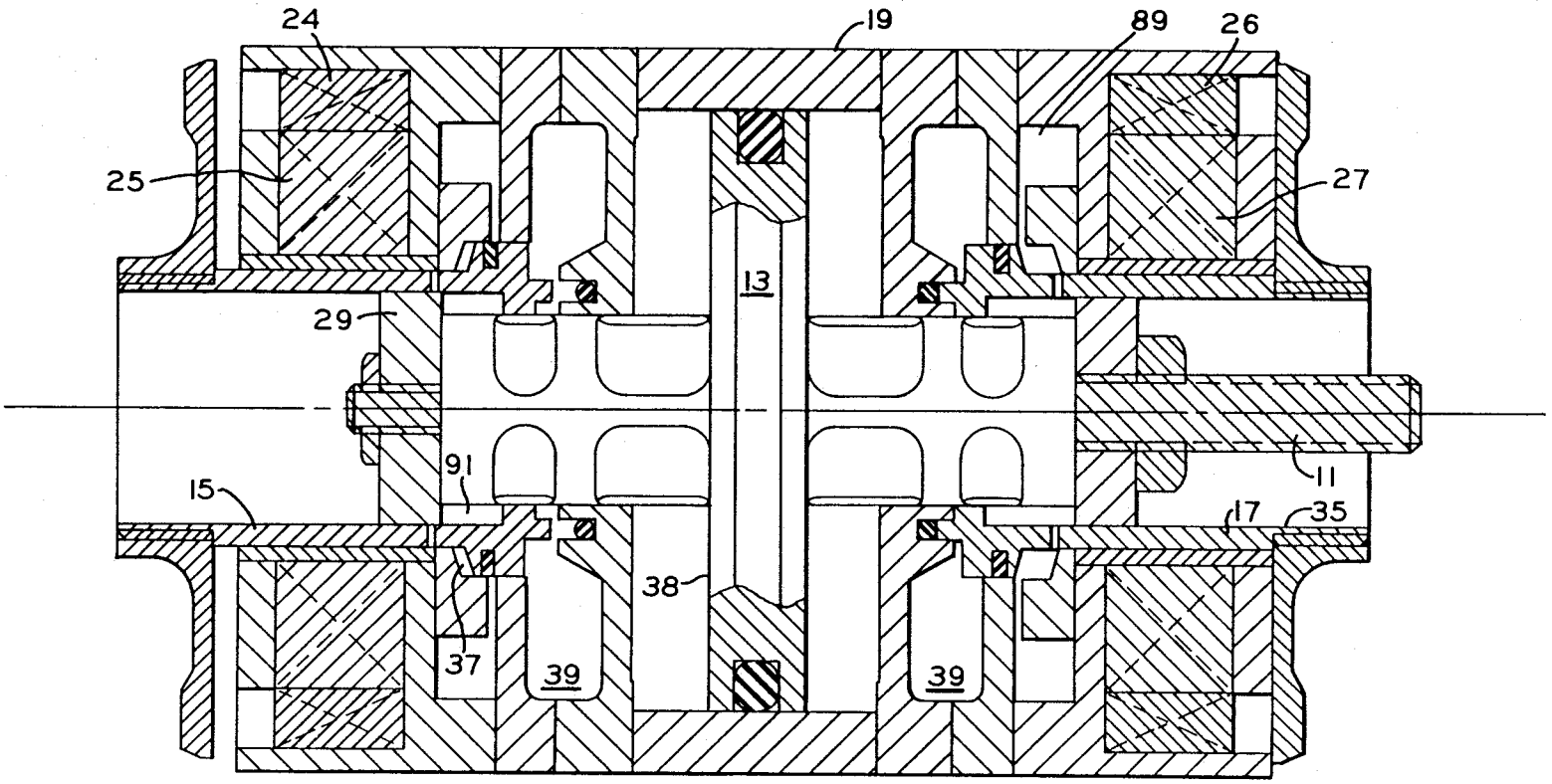

In FIG. 12 the pressure in subchamber 37 and subpiston chamber 91 has overcome the source pressure in chamber 39 causing air valve 15 to be accelerated back toward its position in FIG. 8. More energy is being extracted from main piston 13 by subpiston 29. The pressure on the left side 38 of main piston 13 is at latching pressure and the pressure on the right side of main piston 13 continues to grow and dampen the actuator.

Figure 13:
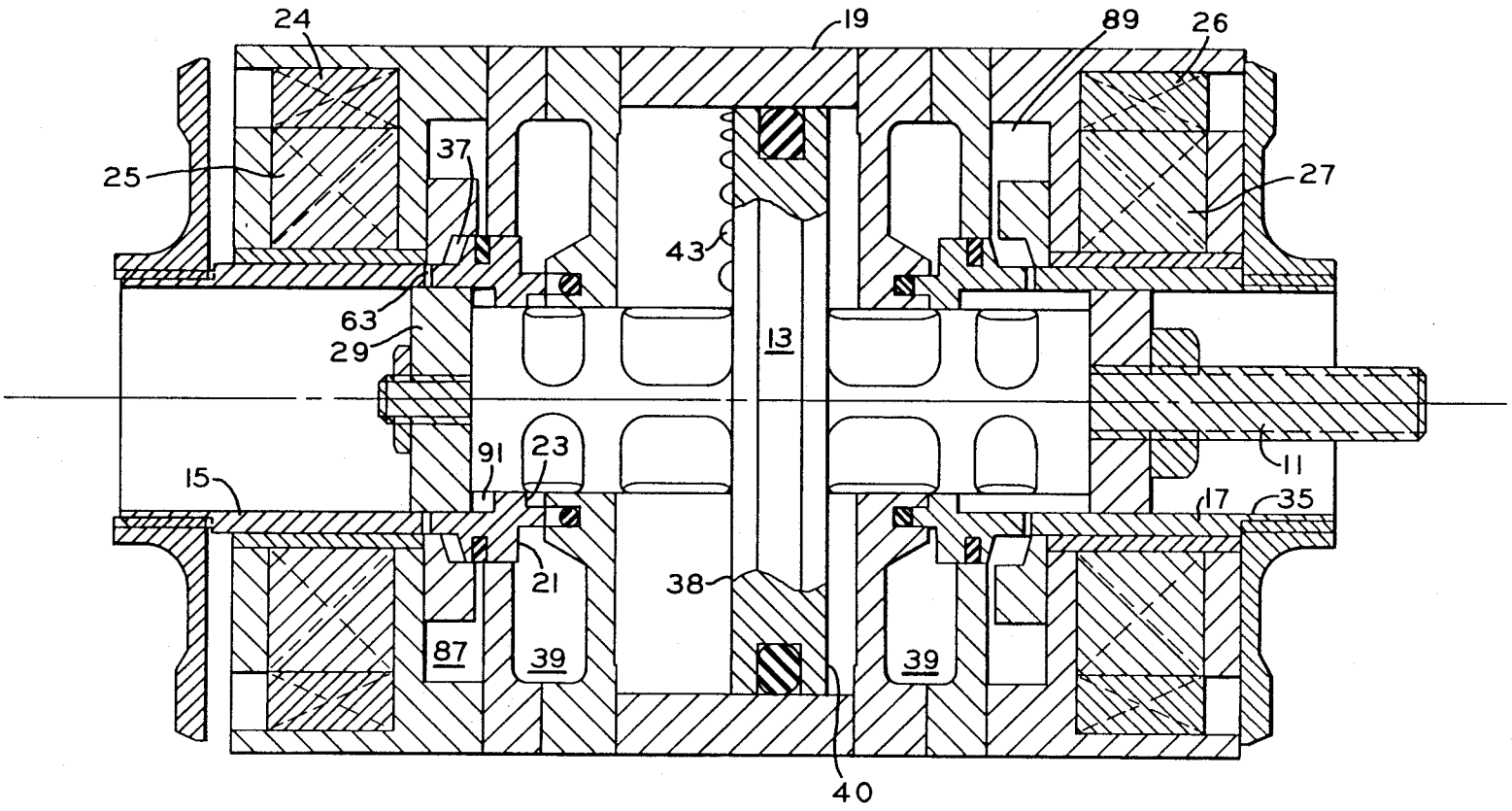

In FIG. 13 the pressure in subchamber 37 and subpiston chamber 91 has further overcome the source pressure in chamber 39 causing air valve 13 to be accelerated further back toward its position in FIG. 8. The tang 77 is now turning off the source pressure across the face 23 of air valve 15. Even more energy is being extracted from main piston 13 by subpiston 29. The pressure on the left side 38 of main piston 13 is at latching pressure and the pressure on the right side 40 of main piston 13 continues to grow and dampen the actuator. The pressure in subpiston chamber 91 still remains high, insuring positive latching of air valve 13. The pressure in subpiston chamber 91 remains high until main piston 13 returns to its position in FIG. 8 and vents subpiston chamber 91 through port 63 and subchamber 87.

Figure 14:
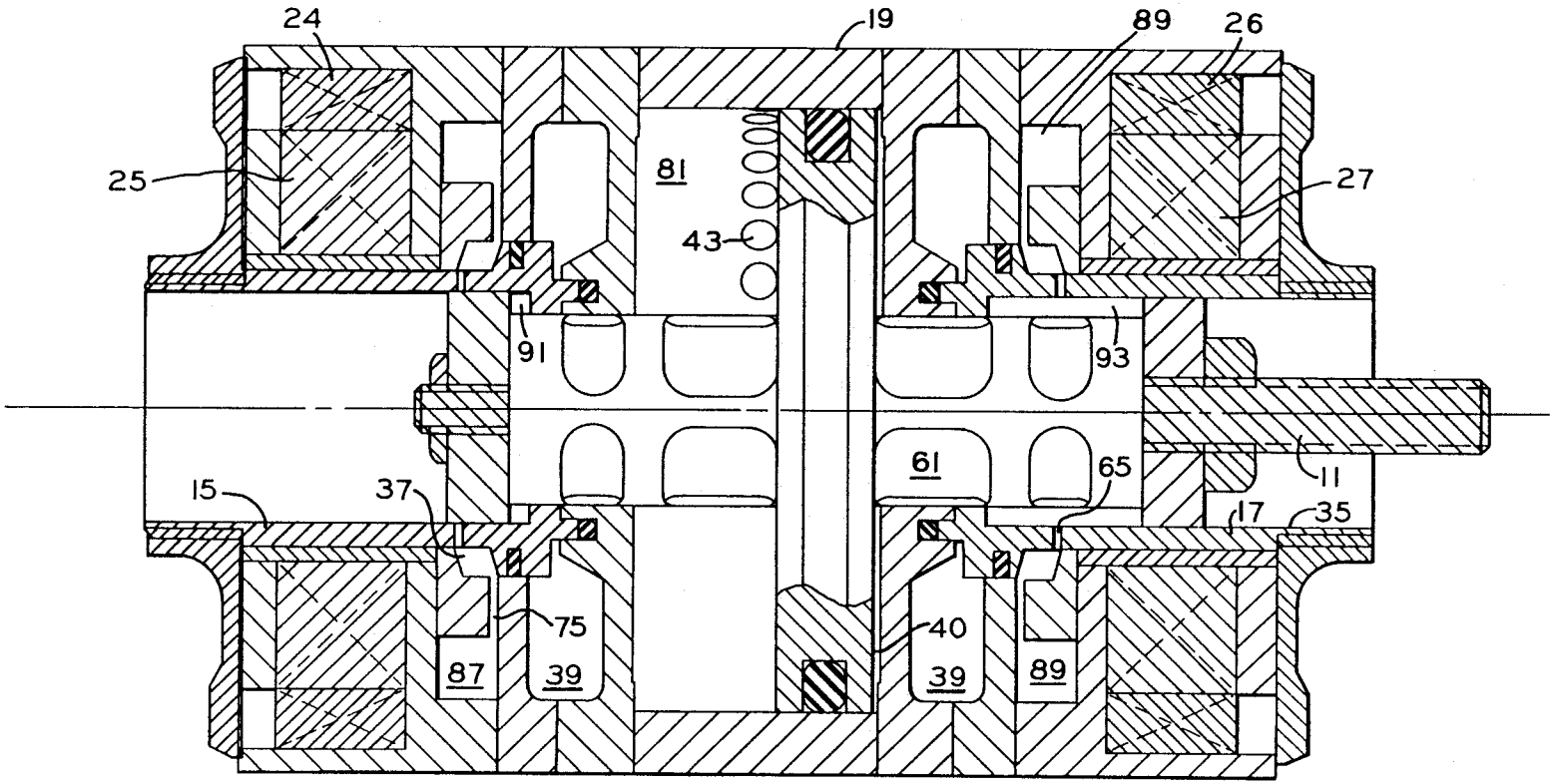

In FIG. 14 the air valve 15 has returned to its position in FIG. 8. The pressure in subchamber 37 has vented to the atmosphere through port 75. The main piston 13 has completed its travel and the damping pressure on the right side 40 of main piston cylinder 81 has vented through window 61 into subpiston chamber 93 through port 65 and out to the atmosphere through subchamber 89. One transition of the actuator is completed.

It will be understood from the symmetry of the valve actuator that the behavior of the air control valves 15 and 17 in utilizing main piston energy for additional valve reclosure force is, as are many of the other features, substantially the same near each of the opposite extremes of the piston travel.

Little has been said about the internal combustion engine environment in which this invention finds great utility. That environment may be much the same as disclosed in the abovementioned copending applications and the literature cited therein to which reference may be had for details of features such as electronic controls and air pressure sources. In this preferred environment, the mass of the actuating piston and its associated coupled engine valve is greatly reduced as compared to the prior devices. While the engine valve and piston move about 0.45 inches between fully open and fully closed positions, the control valves move only about 0.125 inches, therefor requiring less energy to operate. The air passageways in the present invention are generally large annular openings with little or no associated throttling losses.

From the foregoing, it is now apparent that a novel electronically controlled pneumatically powered actuator has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A bistable electronically controlled fluid powered transducer having a piston reciprocable along an axis between first and second positions; a control valve reciprocable along said axis between open and closed positions; latching means for holding the control valve in the closed position; an electromagnetic arrangement for temporarily overpowering the latching arrangement to release the control valve to move from the closed position to the open position; a source of high pressure fluid; energization of the electromagnetic arrangement causing movement of the control valve in one direction along the axis and applying high pressure fluid to a portion of the piston to drive the piston in the opposite direction from the first position to the second position along the axis; and means responsive to piston movement for returning the control valve to the closed position.

2. A pneumatically powered valve actuator comprising a valve actuator housing; a piston reciprocable within the housing along an axis, the piston having a pair of oppositely facing primary working surfaces; and pressurized air source; and pair of air control valves reciprocable along said axis relative to both the housing and the piston between open and closed positions; means for selectively opening one of said air control valves to supply pressurized air from the air source to one of said primary working surfaces causing the piston to move; means for supplying air from the air source to the said one air control valve for reclosing the said one air control valve; and means responsive to movement of the piston for increasing the pressure of the air supplied to said one air control valve to aid in reclosing and maintaining closed the said one air control valve.

3. A pneumatically powered valve actuator comprising a valve actuator housing; a piston reciprocable within the housing along an axis, the piston having a pair of oppositely facing primary working surfaces; a pressurized air source; a pair of air control valves reciprocable along said axis relative to both the housing and the piston between open and closed positions; means for selectively opening one of said air control valves to supply pressurized air from the air source to one of said primary working surfaces causing the piston to move; and pneumatic means for both decelerating the piston near the extremities of its reciprocation and supplying air at a pressure above the pressure of the pressurized source to aid reclosing of said one air control valve.

4. A pneumatically powered valve actuator comprising a valve actuator housing; a main piston reciprocable within the housing along an axis; a pair of auxiliary pistons fixed to and movable with the main piston, the main piston having a pair of oppositely facing primary working surfaces; a pressurized air source; a pair of air control valves reciprocable along said axis relative to both the housing and the main piston between open and closed positions; means for selectively opening one of said air control valves to supply pressurized air from the air source to one of said primary working surfaces causing the main piston and the pair of auxiliary pistons to move; and means responsive to the motion of one of the auxiliary pistons for urging the one air control valve toward its closed position.

5. The pneumatically powered valve actuator of claim 4 wherein each auxiliary piston forms, in conjunction With a surface of the corresponding air control valve, a variable volume annular chamber.

6. The pneumatically powered valve actuator of claim 5 wherein the means responsive to motion includes the variable volume annular chamber, the pressure within the variable volume annular chamber associated with said one air control valve being initially at atmospheric pressure and increasing throughout the time during which the main piston moves.

* * * * *